US008467563B2

(12) United States Patent
Van Der Beek et al.

(10) Patent No.: US 8,467,563 B2
(45) **Date of Patent: *Jun. 18, 2013**

(54) HEADSET WITH FOLDABLE MICROPHONE ARM

(75) Inventors: Willem Hendrik Van Der Beek, Virum (DK); Martin Bech, Frederikssund (DK); Cathrine Rydahl Gadiel, Charlottenlund (DK); Nils Toft, Naerum (DK)

(73) Assignee: GN Netcom A/S (DK)

( * ) Notice: Subject to any disclaimer, the term of this patent is extended or adjusted under 35 U.S.C. 154(b) by 0 days.

This patent is subject to a terminal disclaimer.

(21) Appl. No.: 13/558,604

(22) Filed: Jul. 26, 2012

(65) Prior Publication Data

US 2013/0005407 A1 Jan. 3, 2013

Related U.S. Application Data

(63) Continuation of application No. 12/602,702, filed as application No. PCT/DK2008/000229 on Jun. 19, 2008, now Pat. No. 8,238,597.

(30) Foreign Application Priority Data

Jun. 26, 2007 (DK) ..... 2007 00918

(51) Int. Cl.
*H04R 25/00* (2006.01)

(52) U.S. Cl.
USPC ..... 381/380; 381/370; 381/375; 381/383

(58) Field of Classification Search
USPC ..... 381/322, 330, 370–371, 374–375, 381/379–381, 383
See application file for complete search history.

(56) References Cited

U.S. PATENT DOCUMENTS

| | | | |
|---|---|---|---|
| 6,122,388 | A | 9/2000 | Feldman |
| D470,123 | S | 2/2003 | Hlas et al. |
| 2002/0016188 | A1 | 2/2002 | Kashiwamura |
| 2002/0111140 | A1 | 8/2002 | Kim |
| 2004/0052362 | A1 | 3/2004 | Bodley et al. |
| 2006/0147075 | A1 | 7/2006 | Vu |
| 2007/0135163 | A1 | 6/2007 | Lee |
| 2008/0152182 | A1 | 6/2008 | Bevirt |

FOREIGN PATENT DOCUMENTS

| | | |
|---|---|---|
| EP | 0 825 796 | 8/1997 |
| EP | 1282974 | 2/2003 |
| WO | WO 01/50813 | 7/2001 |
| WO | WO 2006/129290 | 12/2006 |

OTHER PUBLICATIONS

International Search Report for PCT/DK2008/000229.

*Primary Examiner* — Suhan Ni
(74) *Attorney, Agent, or Firm* — Altera Law Group, LLC

(57) ABSTRACT

A headset (1; 101; 102) comprising a housing (2; 102; 103) and a microphone arm (3; 103; 203). The microphone arm (3; 103; 203) is connected to a hinge member (4; 104; 204), which is pivotally connected to the housing (2; 102; 103) such that the microphone arm (3; 103; 203) can be rotated about a first pivot axis (P1; P101; P201) between a first position, in which it lies along a first surface (9; 109; 209) of the housing (2; 102; 202) and a second, extended position in which it extends away from the housing (3; 103; 203). The microphone arm (3; 103; 203) is movably connected to the hinge member (4; 104; 204) so that the microphone arm (3; 103; 203) can be moved into a third position, in which it lies along a second surface (10; 110; 210) of the housing (2; 102; 202).

11 Claims, 3 Drawing Sheets

HEADSET WITH FOLDABLE MICROPHONE ARM

TECHNICAL FIELD

The invention relates to a headset according to the preamble of claim 1.

BACKGROUND ART

EP 1 282 974 B1 discloses a headset according to the preamble of claim 1. Such a headset is commonly used in connection with mobile phones. The headset can be a wireless headset using Bluetooth protocols. Such a headset is especially convenient to use if a lot of time is spent every day with telephone calls. The user has his hands free for other purposes, such as car driving. When not in use the microphone arm can be folded to lie up against the housing, whereby the headset is in a compact state and is easy to store in a pocket or bag. Furthermore, movement of the microphone arm between the two positions activates the switch, which causes a change in headset mode.

DISCLOSURE OF INVENTION

An object of the invention is to improve a headset according to the preamble of claim 1.

The headset according to the invention is characterized in that the microphone arm is movably connected to the hinge member so that the microphone arm can be moved into a third position, in which it lies along a second surface of the housing. In this way, the headset can be moved into a compact state without changing the headset mode to the mode that corresponds to the first position of the microphone arm.

According to an embodiment, the headset is wireless and turned off, when the microphone arm is in the first position. In the off-position, the headset does not consume power or communicate with any other device. Thus, the user can turn the headset on by moving the microphone arm from the first position to the third position and keep it in compact state in his pocket. Furthermore, he is able to feel with his hand whether the headset lying in his pocket is turned off or not.

According to an embodiment, the microphone arm is pivotally connected to the hinge member so that the microphone arm can rotate about a second pivot axis.

The second pivot axis can be perpendicular or parallel to the first pivot axis.

Alternatively, the microphone arm can be slidably connected to the hinge member.

According to an embodiment, the first surface faces the user's head during use. In this case, the second surface may faces opposite the user's head during use. This is an advantage, as the user may move the microphone arm from the second position to the third position and vice versa, while the headset is worn on the ear.

The hinge member is preferably connected to the housing at an outer periphery of the housing. If the outer dimensions of microphone arm are of the same order or less than the housing, a very compact headset is obtained, when the microphone arm is in the first or the third position.

According to an embodiment, the movement of the microphone arm from the second position to the third position activates a switch and changes headset mode. In this way, it is possible to assign three different modes to the three different positions of the microphone arm.

Thus, the following modes can be assigned to the three positions: the headset is turned off, when the microphone arm is in the first position; the headset is in communication mode, when the microphone arm is in the second position; and the headset is in standby mode, when the microphone arm is in the third position. Thus, the user can put the microphone arm in the first position, when he does not want use it. When he wants to place a call, he can switch the headset on by turning the microphone arm from the first position to the second, extended position. To end the call he moves the microphone arm to the third position. To receive a call, he just moves the microphone arm from the third position to the second position.

In the third position, the headset is standby position. This means, that the headset communicates with an external device, e.g. such that it is able to receive a signal about an incoming telephone call.

BRIEF DESCRIPTION OF THE DRAWINGS

The invention is explained in detail below with reference to the drawing illustrating a preferred embodiment of the invention and in which.

Figure 1:
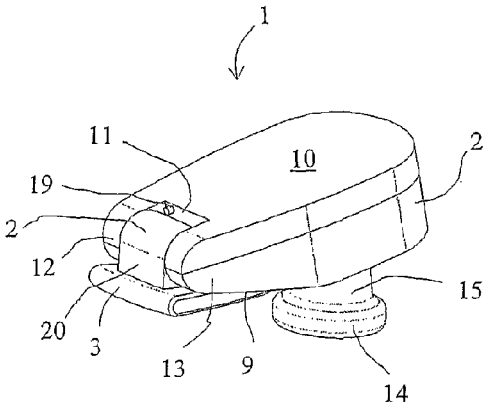
FIG. 1 is a perspective view of a first embodiment of a headset according to the invention, where the microphone arm is in a first position.
Figure 2:
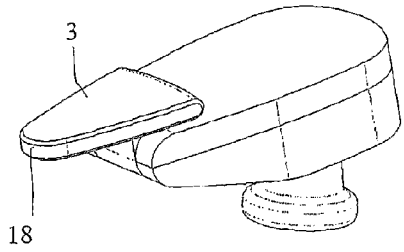
FIG. 2 shows the headset of FIG. 1 with the microphone arm in a second, extended position.
Figure 3:
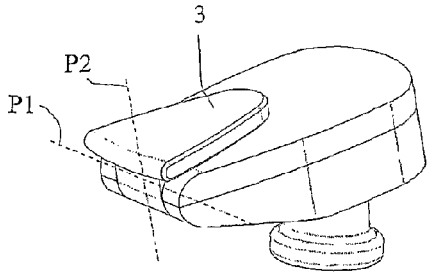
FIG. 3 shows the headset of FIGS. 1 and 2 with the microphone in a third position.
Figure 4:
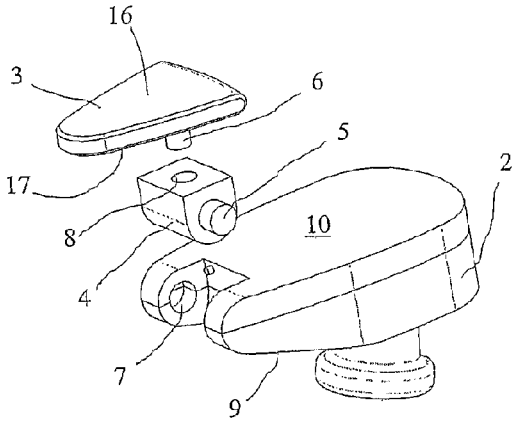
FIG. 4 is headset of FIGS. 1-3 in exploded view.

The following reference signs are used in the figures and the following detailed description of the preferred embodiment.

1, 101, 101 headset
2, 102, 202 housing
3, 103, 203 microphone arm
4, 104, 204 hinge member
5 first pivot
6 second pivot
7 bearing
8 bearing
9, 109 inner surface
10, 110 outer surface
11 recess
12 bracket
13 bracket
14, 114, 214 earbud
15 earbud stem
16 outer side of microphone arm
17 inner side of microphone arm
18 tip of microphone arm
19 switch

20 back surface of hinge member
221 protrusion with T-profile
222 first web of T-profile
223 second web of T-profile
224 longitudinal channel in microphone arm
225 longitudinal slot in microphone arm
P1, P101 first pivot axis
P2, P102 second pivot axis

MODES FOR CARRYING OUT THE INVENTION

FIGS. 1-4 disclose a first embodiment of a headset 1 according to the invention. Main elements of the headset 1 are: a housing 2, a movable microphone arm 3 and an earbud 14. The headset is a wireless headset using the Bluetooth protocol. The housing 2 contains among other things transmitter/receiver electronics and a rechargeable battery. A speaker is arranged in the earbud 14, and a microphone transducer is arranged in the tip 18 of the microphone arm 3.

The housing 2 has a first surface 9 facing the head of the user during use and a second surface 10, which lies opposite the first surface 9 and faces away from the users head. The earbud 11, which has an earbud stem 15 and protrudes from the first surface 9 of the housing 2, is adapted to be inserted into the lower concha of the human ear during use. When the headset is mounted in the ear, the earbud stem 15 extends through the intertragic notch between the tragus and the antitragus. The earbud 11 engages the inner sides of the tragus and the antitragus. Additionally or instead of a concha engaging earbud, the headset may comprise a wearing device, such as an earhook, an earloop, an ear clip, a headband or a neckband.

The microphone arm 3 is movably connected to the housing 2 by means of a hinge member 4. The hinge member 4 is placed in a recess 11 between two brackets 12, 13 protruding from the housing 2. Two first coaxial pivots 5 protrude from the hinge member 4 and engage corresponding bearings 7 in the brackets 12, 13. Only one of the first pivots 5 and one of the bearings 7 are visible in FIG. 4. Due to the first pivots 5 and their corresponding bearings 7 the hinge member 4 can rotate about an axis P1. The shape and size of the hinge member 4 are adapted to the recess 11 so that the hinge member can rotate a little less than 180° between a first position shown in FIG. 1 and a second position shown in FIG. 2.

The microphone arm 3, which has an almost triangular shape with rounded corners, has an outer surface 16 and an inner surface 17. A second pivot 6 protrudes from the inner surface 17 of the microphone arm 3 and engages a corresponding bearing 8 in the hinge member 4. Thus, the microphone arm 3 is able to rotate about a second axis P2 that is essentially perpendicular to the first axis P1, between the second position and a third position.

Movement of the microphone arm 3 between the three positions activates one or more switches. A switch 19 is visible in FIGS. 1 and 4. When the microphone arm 3 is in the second or third positions shown in FIGS. 2 and 3, the back surface 20 of the hinge member 4 presses the switch 19, whereby the switch is activated. A second switch is not visible, as it is placed on the inner side 17 of the microphone arm 3, such that the outer surface 10 of the housing 2 presses the switch only when the microphone arm 3 is in the third position shown in FIG. 3. The switches changes modes of the headset, and a typical configuration could be:

The microphone arm 3 in the first position (FIG. 1): the headset is turned off The microphone arm 3 in the second position (FIG. 2): the headset is in communication mode The microphone arm 3 in the third position (FIG. 3): the headset is in standby mode In the first position, battery is saved and there is no Bluetooth link established between the headset and any other device, such as a mobile phone, base station or PC. In the second position, where the microphone arm 3 is extending away from the housing 2, the microphone in the tip 18 of the microphone arm 3 is "open" such that it can catch sound from the users mouth. In the third position, a Bluetooth link is established between the headset 1 and another Bluetooth device. In this mode, the headset may be able to alert the user by means of a sound or vibration about an incoming call.

When the microphone arm 3 is in the third position, it is lying along the housings 2 second surface 10 that faces away from the users head. Thus, a movement of the microphone arm 3 between the second and the third position does not interfere with the users head. Thus, he can easily switch between these two positions, e.g. to answer or and a call, while the headset is placed on the ear.

FIGS. 5-8 disclose in a schematically way a second embodiment of a headset 101 according to the invention. This second embodiment also has a housing 102, a movable microphone arm 103 and a hinge member 104 connecting the housing 102 and the microphone arm 103.

This second embodiment differs from the first embodiment by the first and the second pivots axes P101, P102 being parallel. The hinge member 104 can rotate in relation to the housing 102 about the first pivot axis P101 and the microphone arm 103 can rotate in relation to the hinge member 104 about the second pivot axis P102.

Figure 5:
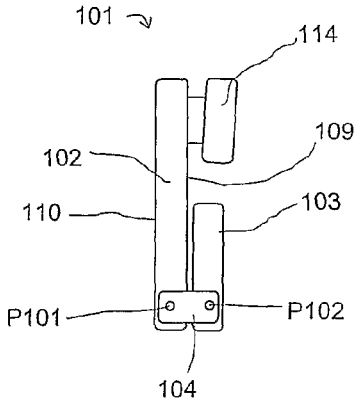
FIG. 5 is a schematically side view a headset according to a second embodiment of the invention, where the microphone arm is in a first position.
Figure 6:
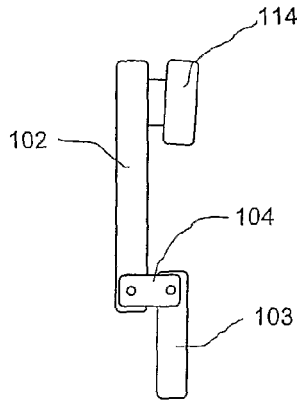
FIG. 6 shows the headset of FIG. 5 with the microphone in a second, extended position.
Figure 7:
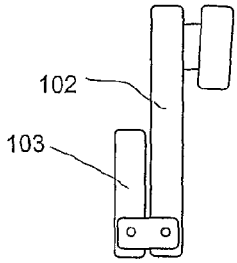
FIG. 7 shows the headset of FIGS. 5 and 6 with the microphone in a third position.
Figure 8:
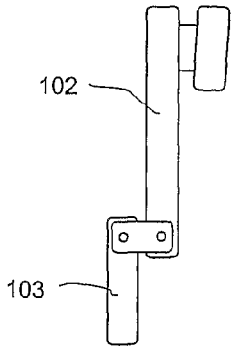
FIG. 8 is the headset of FIGS. 5-7 with the microphone arm in a fourth, extended position.

FIG. 5 discloses the microphone arm 3 in a first position where the microphone arm 3 is folded up against the inner surface 109 of the housing 103. FIG. 6 discloses the microphone arm 103 in a second position in which it extends away from the housing 102. FIG. 7 discloses the microphone arm 103 in a third position in which the microphone arm 103 is folded up against the outer side 110 of the housing 102. FIG. 8 discloses the microphone arm 103 in a fourth position in which it extends away from the housing 102. The figures are schematically only disclosing the positions of the microphone arm 103 and the positions of the pivot axes P101, P102. The hinge member can be pivoting in recesses in the housing 102 and the microphone arm 103 corresponding to recess 11 in the housing 2 of the first embodiment. The switches detecting the different positions of the microphone arm 103 or hinge member 104 are not shown in the figures but can be arranged in the recesses of the housing 102 and the hinge member 104, in the hinge member 104 or in the walls of the housing 102 or microphone arm 103.

The friction in the hinge of the first pivot axis P101 is chosen to be greater than the friction in the hinge of the second pivot axis P102. Thus, a rotation about the second pivot axis P102 will take place before rotation about the first pivot axis P101 when the user forces the microphone arm 103 away from the first position disclosed in FIG. 1. Thus, the microphone arm 103 will initially move from the first position disclosed in FIG. 1 to the second, extended position disclosed in FIG. 6. If the user forces the microphone arm 103 further, rotation about the first pivot axis 101 will start and the microphone arm 103 will end in the third position shown in FIG. 7. When the user pulls the microphone arm back from the third position shown in FIG. 7 towards an extended position, the microphone arm 103 will rotate about the first pivot axis P101 until the microphone arm 103 reaches the fourth position shown in FIG. 8. A further movement will cause a rotation about the second pivot axis until the first position is reached.

The switching can be arranged such that the second and the fourth positions correspond to an identical mode, e.g. communication mode. The above description of the movement is a result of how the hinging mechanism between the hinge member 104 and the housing 102 and the microphone arm 103 is designed. Appropriate shaped ends of the housing 103 and the microphone arm 103 ensures a smooth uncomplicated movement.

A different and more controlled movement can be obtained, if the microphone arm end and the housing end are in a mutual meshed engagement. In this way, they will rotate in opposite directions like gear wheels.

Figure 9:
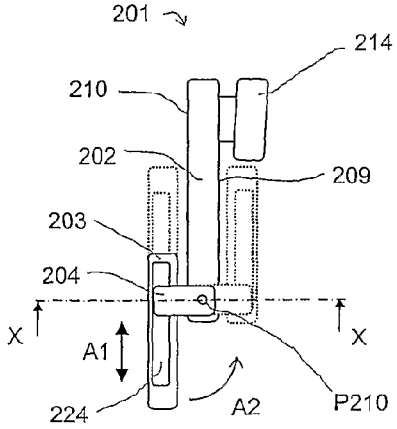
FIG. 9 is a schematically side view of a headset according to a third embodiment of the invention, where the microphone arm is in a second, extended position, and where the microphone arm is shown with dashed lines in the first and third positions, FIG. 10 a cross sectional view taken along the line X-X in FIG. 9.
Figure 10:
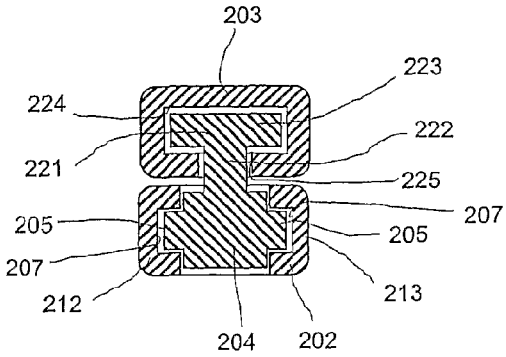

FIGS. 9 and 10 disclose a third embodiment of a headset 201 according to the invention. In this embodiment the microphone arm 203 is slidably mounted on the hinge member 204. FIG. 9 discloses in a very schematically way that the microphone arm 203 has a longitudinal channel 224 which receives a protrusion T-shaped profile extending from the hinge member 204. The arrow A1 indicates how the microphone arm 203 can be moved in the longitudinal direction between the shown extended, second position and a third position shown with dashed lines. The arrow A2 shows how the hinge member 204 and the microphone arm 203 can be rotated about a first pivot axis P201 between the first (shown with dashed lines) and the second, extended position.

FIG. 10 is a cross sectional view taken along the line X-X in FIG. 9. The hinge member 204 has two first pivots 205 received in bearings 207 in two brackets 212, 213 extending from the housing 202. Thus, the hinge connection between the hinge member 204 and the housing 202 corresponds to the hinge connection between the hinge member 4 and the housing 2 of the headset shown in FIGS. 1-4. A protrusion 221 with a T-profile is extending from hinge member 204. A "standing" first web 222 of the T-profile extends through a longitudinal slot 225 in the microphone arm 203 and a "lying" second web 223 is received in the longitudinal channel 224 in the microphone arm 224. In this way, the microphone arm 203 can slide on the protrusion 221 between the second and the third position.

In all three embodiments, the first position of the microphone is on the surface facing the users head. It is very logical to assign this position with a mode, where the headset is switched off, as the microphone arm is hidden when the headset is mounted on the head.

In the patent claims, it is mentioned the microphone arm lies along the housing in the first and the third positions. This means that the microphone arm can abut the surface of the housing, and/or be received in a recess in the housing surface of the headset and/or lie close to the housing surface without touching it.

The headset can be provided with lock and release means such that the microphone arm can be locked in one or more of the first, second and third positions. Thus, some kind of release button or release tab could be provided and activated to release the microphone arm from the locked position.

Furthermore, spring means could be provided to urge the microphone arm into one or more of the first, second and third positions. A tristable spring mechanism could be arranged to provide three stable rest positions for the microphone arm.

One or more buttons could be arranged on the housing such that they are hidden beneath the microphone arm in the first or the third position of the microphone arm. It would especially be an advantage if the third position of the microphone arm was along the surface of the headset facing away from the user and the buttons were arranged on this surface. Then, the user could activate these buttons when he is wearing the headset and the microphone is in the second, extended position. These hidden buttons could be "volume up" and "volume down".

The microphone arm is preferably provided with a microphone transducer near the tip. However, the microphone transducer could alternatively be arranged in the housing and a so-called sound tube could be arranged in or on the microphone arm. In this case, there is no need for electrical connections across the hinging mechanism.

The switch that changes mode when the microphone arm is moved from the first position to the second position, could be a component mainly located inside the housing, where the actuator extends out through an opening in the housing wall. This is the case with the switch 19 shown in FIGS. 1 and 4.

The electrical connections to the microphone transducer in the microphone arm could be provided as a flexible wire bridging the hinge mechanism. Alternatively, the electrically conducting surfaces on the hinging mechanism could be provided to establish electrical contact between the parts that moves in relation to each other. These electrical surfaces could be embodied such that electrical connections are only established in certain positions of the hinge parts. Thus, switching and connectivity could be combined.

In the description the following modes has been mentioned: "off", "communication" and "standby". However, the different positions of the microphone arm could be assigned to other modes, such as "mobile phone mode", "audio player mode", "PC mode", "microphone mute" etc.

The switch that changes headset mode by the movement of the microphone arm can be a mechanically operated switch, which means that a switch actuator is moved to activate the switch. However, an optical or magnetic actuated switch could also be used. Furthermore, one switch could be used to detect three or more positions of the microphone arm.

The invention claimed is:

1. A headset comprising a housing and a microphone arm connected to a hinge member, which is pivotally connected to the housing such that the microphone arm can be rotated about a first pivot axis between a first position, in which it lies along a first surface of the housing and a second, extended position in which it extends away from the housing, and where the headset is further provided with a switch, which is operably connected to the microphone arm or the hinge member, such that moving of the microphone arm from the first position to the second position or vice versa activates the switch and changes headset mode, characterized in that the microphone arm is movably connected to the hinge member so that the microphone arm can be moved into a third position, in which it lies along a second surface of the housing.

2. A headset according to claim 1, wherein the headset is wireless and turned off, when the microphone arm is in the first position.

3. A headset according to claim 1, wherein the microphone arm is pivotally connected to the hinge member so that the microphone arm can rotate about a second pivot axis.

4. A headset according to claim 3, wherein the second pivot axis is perpendicular to the first pivot axis.

5. A headset according to claim 3, wherein the second pivot axis is parallel to the first pivot axis.

6. A headset according to claim 1, wherein the microphone arm is slidably connected to the hinge member.

7. A headset according to claim 1, wherein the first surface faces the users head during use.

8. A headset according to claim 1, wherein the second surface faces opposite the user's head during use.

9. A headset according to claim 1, wherein the hinge member is connected to the housing at an outer periphery of the housing.

10. A headset according to claim 8, wherein outer dimensions of microphone arm is of the same order or less than the housing.

11. A headset according to claim 1, wherein the movement of the microphone—arm from the second position to the third position activates a switch and changes headset mode.

* * * * *